United States Patent [19]

Ozawa et al.

[11] Patent Number: 4,874,688

[45] Date of Patent: Oct. 17, 1989

[54] SILVER HALIDE PHOTOGRAPHIC MATERIALS COMPRISING SPECIFIC ORGANIC SOLVENTS

[75] Inventors: Takashi Ozawa; Hidetoshi Kobayashi, both of Kanagawa, Japan

[73] Assignee: Fuji Photo Film Co., Ltd., Kanagawa, Japan

[21] Appl. No.: 164,372

[22] Filed: Mar. 4, 1988

[30] Foreign Application Priority Data

Mar. 4, 1987 [JP] Japan ..... 62-49083

[51] Int. Cl.[4] ..... G03C 7/26; G03C 1/06

[52] U.S. Cl. ..... 430/546; 430/541; 430/543

[58] Field of Search ..... 430/546, 541, 543

[56] References Cited

U.S. PATENT DOCUMENTS 4,451,558 5/1984 Sugita et al. ..... 430/553
4,731,320 3/1988 Sasaki et al. ..... 430/546

FOREIGN PATENT DOCUMENTS 54-91325 7/1979 Japan .
109035 6/1983 Japan .
59-105645 6/1984 Japan .
59-109053 6/1984 Japan .
59-149348 8/1984 Japan .
59-171953 9/1984 Japan .

*Primary Examiner*—Paul R. Michl
*Assistant Examiner*—Patrick Doody
*Attorney, Agent, or Firm*—Sughrue, Mion, Zinn, Macpeak & Seas

[57] ABSTRACT

For incorporation of substantially water-insoluble photographic additives such as couplers into hydrophilic organic colloid layers of silver halide photographic materials, a phthalic acid ester of a formula (I):

(I)

where $R_1$ and $R_2$ may be same or different and each represents a branched alkyl group having no more than 7 carbon atoms, is used so that said additives can effectively be dispersed in the colloid layers. Accordingly, the solubility and dispersibility of the additives is improved; the long-term stability of the additive dispersion is improved, and further the latent image storability and color-forming properties of the photographic material are also improved over the prior art photographic materials.

6 Claims, No Drawings

SILVER HALIDE PHOTOGRAPHIC MATERIALS COMPRISING SPECIFIC ORGANIC SOLVENTS

FIELD OF THE INVENTION

The present invention relates to a silver halide photographic material, and in particular, to one or more substantially water-insoluble photographic additives have been dispersed in a specific phthalic acid ester and the resulting dispersion incorporated into a hydrophilic organic colloid layer. More precisely, it relates to a silver halide color photographic material which exhibits excellent solubility and dispersability with respect to the substantially water-insoluble photographic additives and excellent long-term storability properties of the dispersions with respect to said additives, as incorporated into the hydrophilic organic colloid layer. The photographic materials of the present invention also have excellent color-forming properties and latent image storability.

BACKGROUND OF THE INVENTION

Substantially water-insoluble photographic additives, for example, oil-soluble couplers, antioxidants to be used for prevention of color fading, color fog or color mixing (such as alkylhydroquinones, alkylphenols, chromans and coumarones), hardeners, oil-soluble filter dyes, oil-soluble ultraviolet absorbents, DIR compounds (such as DIR hydroquinones and colorless DIR compounds), developing agents, dye developing agents, DDR redox compounds DDR couplers, are dissolved in a suitable high boiling point solvent, and the resulting solution is dispersed in a hydrophilic organic colloid, such as a gelatin solution, in the presence of a surfactant, whereby said additives are incorporated into the hydrophilic organic colloid layer. Examples of hydrophilic organic layers include light-sensitive emulsion layers, filter layers, backing layers, anti-halation layers, interlayers and protective layers. As the high boiling point organic solvent, phthalic acid ester series compounds and phosphoric acid ester series compounds are preferred.

Phthalic acid ester series compounds, known in the photographic arts, display excellent coupler-dispersability properties and have a high affinity for various organic colloid layers such as gelatin. Moreover, they have been known to favorably influence both the stability and the hue of the color images formed as well as the stability of the chemicals in the photographic material prior to development. The phthalic acid esters are readily available at a low cost. Examples of these compounds are described Japanese Patent Application (OPI) Nos. 91325/79, 149348/84, 216245/83, 109053/84, and 171953/84. (The term "OPI" as used herein means a "published unexamined Japanese patent application.) However, these known phthalic acid ester series compounds have been found to be insufficient for use in the recently developed high-quality light-sensitive photographic materials with respect to their solubility, dispersibility and long-term stability of the dispersion, color forming property and latent image storability.

SUMMARY OF THE INVENTION

Accordingly, an object of the present invention is to provide a silver halide color photographic material comprising at least one specific phthalic acid ester compound which exhibits excellent solubility, dispersability and long-term storability of the dispersion with respect to the photographic additives but which is free from the drawbacks of other known phthalic acid esters such as poor solubility, dispersibility, long-term stability of the dispersion, color-forming ability and latent image storability.

Another object of the present invention is to provide a high boiling point organic solvent suitable for photographic materials which prevents the color fading of color images caused by light, heat and moisture; which has a large preventative effect against stains and which exhibits excellent solubility, dispersibility and long-term storability of the dispersion with respect to the additive incorporated in the photographic material and excellent color forming property and latent image storability.

The present inventors earnestly studied have discovered that the objects of the present invention can be attained by a silver halide color photographic material comprising one or more hydrophilic organic colloid layers which layers contain photographic additives as dispersed therein with a phthalic acid esters of the general formula (I):

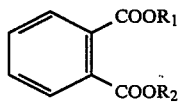

(I)

wherein $R_1$ and $R_2$, which may be same or different, each represents a branched alkyl group having 7 carbon atoms.

DETAILED DESCRIPTION OF THE INVENTION

Specific examples of the esters of the formula (I) are represented below as formulae S-1 to S6. The esters can be used singly or in the form of a mixture thereof.

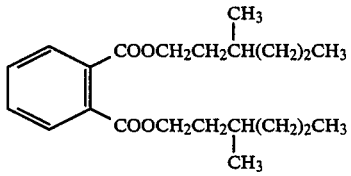

S-1

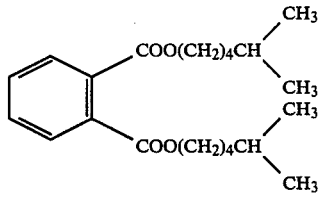

S-2

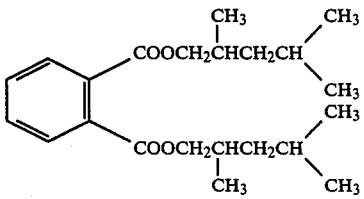

S-3

-continued

S-4

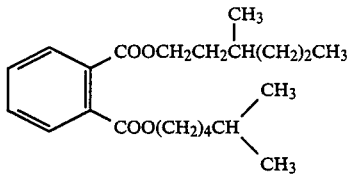

S-5

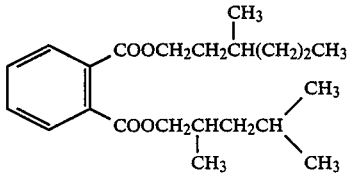

S-6

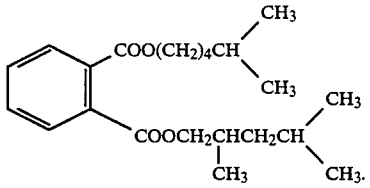

The amount of the esters of the formula (I) used in the present invention is from 0.02 g to 3 g per g of coupler used in the photographic material of the invention.

Examples of photographic additives for use in the present invention include color couplers (more preferably cyan couplers) which are substantially water-insoluble (or easily soluble in organic solvents) and other photographic additives as described below.

Examples of various kinds of color couplers are described in the patent publications as referred to in *Research Disclosure* (RD) No. 17643, VII-C to G.

As yellow couplers, for example, those described in U.S. Pat. Nos. 3,933,501, 4,022,620, 4,326,024 and 4,401,752; Japanese Patent Publication No. 10739/83; and British Pat. Nos. 1,425,020 and 1,476,760 are preferred.

As magenta couplers, 5-pyrazolone series and pyrazoloazole series compounds are preferred. Those couplers described in U.S. Pat. Nos. 4,310,619, 4,351,897, 3,061,432, 3,725,067, 4,500,630 and 4,540,654; European Pat. No. 73,636; *Research Disclosure* No. 24220 (June, 1984) and ibid., No. 24230 (June, 1984); Japanese Patent Application (OPI) Nos. 33552/85 and 43659/85 are especially preferred.

As cyan couplers, there are phenol series and naphthol series couplers. Those couplers described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,729, European Pat. No. 121,365A, U.S. Pat. Nos. 3,446,622, 4,333,999, 4,451,559 and 4,427,767, European Pat. No. 161,626A are preferred.

As colored couplers for correcting the unnecessary absorption of colored dye, those described in *Research Disclosure* No. 17643 VII-G, U.S. Pat. No. 4,163,670, Japanese Patent Publication No. 39413/82, U.S. Pat. Nos. 4,004,929 and 4,138,258, and British Pat. No. 1,146,368 are preferred.

As couplers capable of forming colored dyes having an appropriate diffusibility, those described in U.S. Pat. No. 4,366,237; British Pat. No. 2,215,570; European Pat. No. 96,570; and West German Patent Application (OLS) No. 3,234,533 are preferred.

Specific examples of polymerized color-forming couplers are described in U.S. Pat. Nos. 3,451,820, 4,080,211 and 4,367,282, and British Pat. No. 2,102,173.

Couplers which release a photographically useful residue with coupling reaction can also preferably be used in the present invention. As DIR couplers which release a development inhibitor, those described in the patent publication mentioned in the aforesaid *Research Disclosure* No. 17643, VII-F, as well as in Japanese Patent Application (OPI) Nos. 151944/82, 154234/82 and 184248/85, and U.S. Pat. No. 4,248,962 are preferred.

As couplers which image-wise release a nucleating agent or a development accelerator during development, those described in British Pat. Nos. 2,097,140 and 2,131,188, and Japanese Patent Application (OPI) Nos. 157638/84 and 170840/84 are preferred.

Other couplers which can be used in the photographic light-sensitive materials of the present invention are the competing couplers described in U.S. Pat. No. 4,130,427; the polyvalent couplers described in U.S. Pat. Nos. 4,283,472, 4,338,292 and 4,310,618; the DIR redox compound-releasing couplers described in Japanese Patent Application (OPI) No. 185950/85 and the couplers releasing a dye which may reproduce the color after released, as described in European Pat. No. 173,302A.

An illustrative but not exhaustive list of color couplers for use in the present invention are represented below in the formulae C-(1) through C-(59).

C-(1)

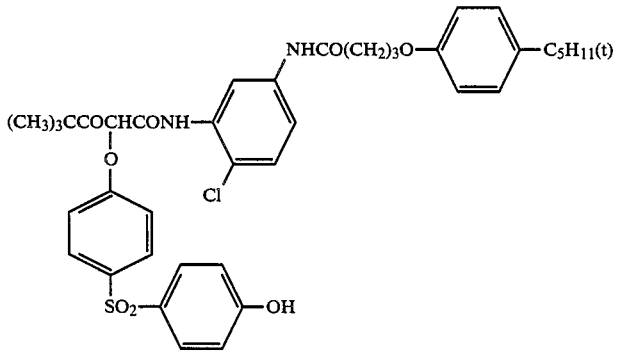

-continued
C-(2)
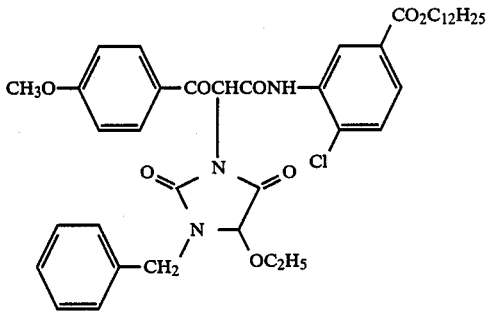
C-(3)
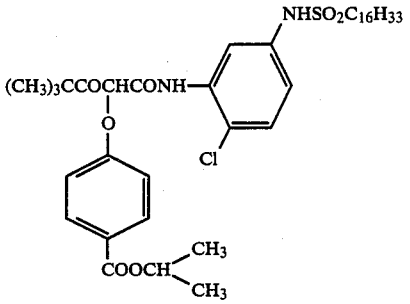
C-(4)
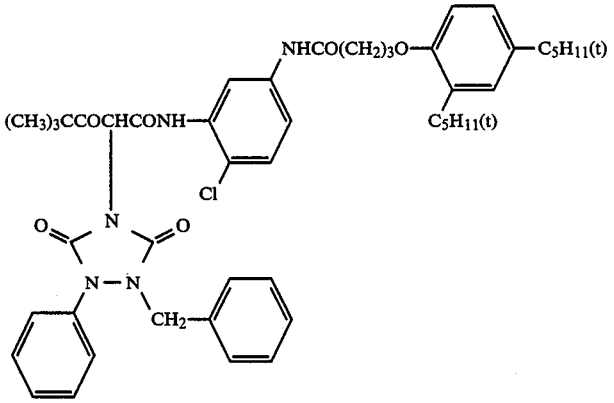
C-(5)
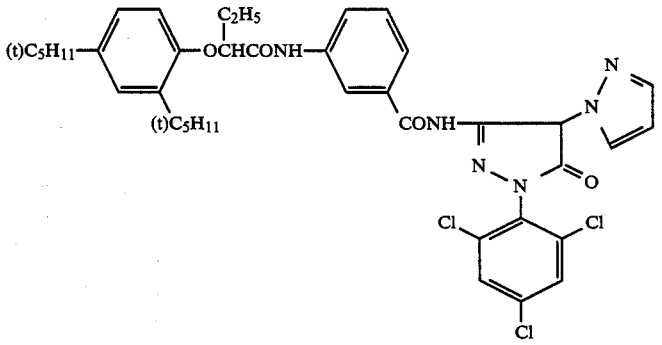
C-(6)
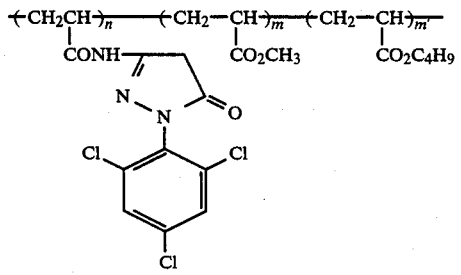

-continued
n/m/m' = 2/1/1 (by weight)
Molecular weight: about 40,000
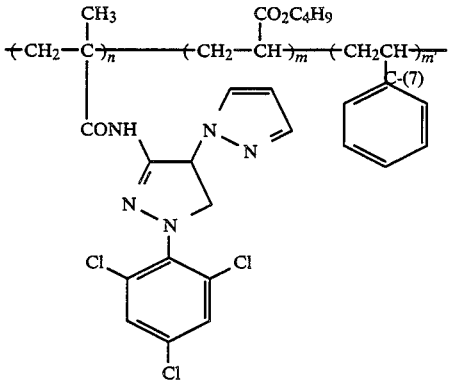
n/m/m' = 50/25/25 (wt %)
Mean molecular weight: about 30,000
C-(8)
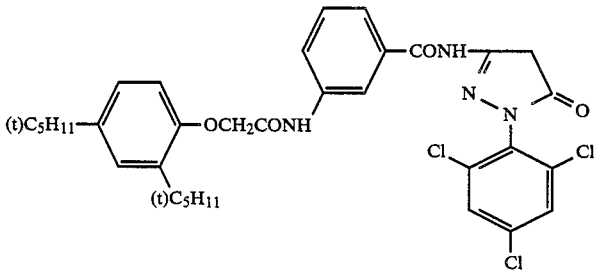
C-(9)
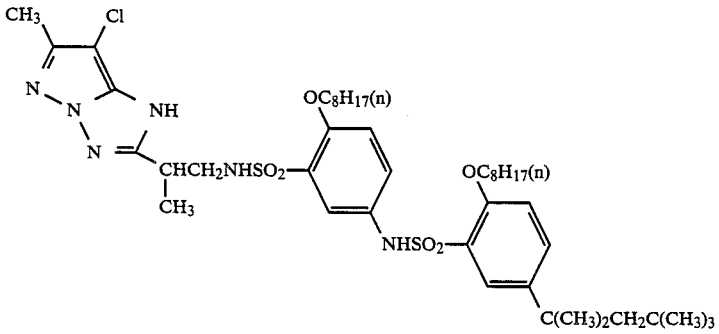
C-(10)
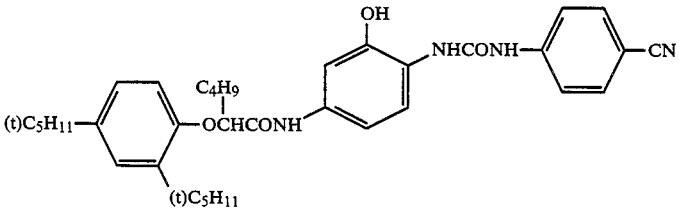

-continued
C-(11)
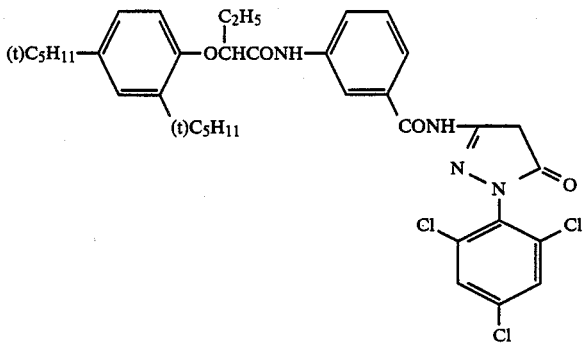
C-(12)
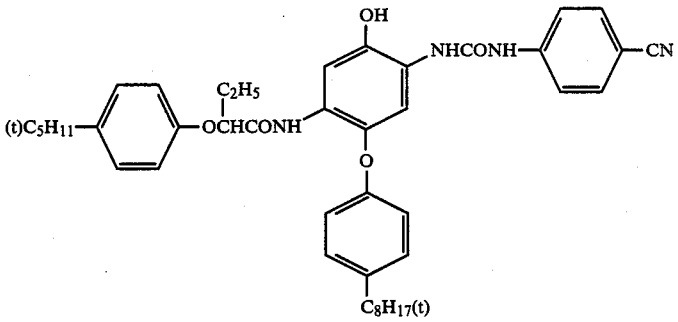
C-(13)
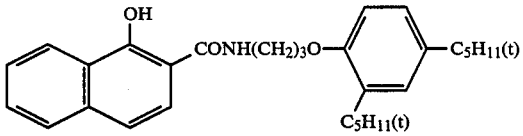
C-(14)
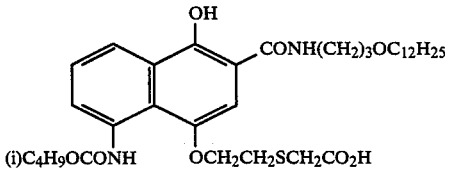
C-(15)
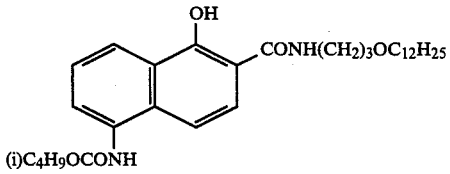
C-(16)
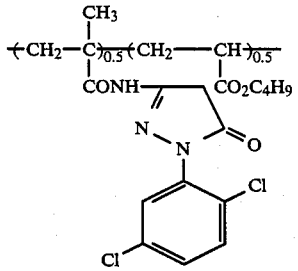
C-(17)
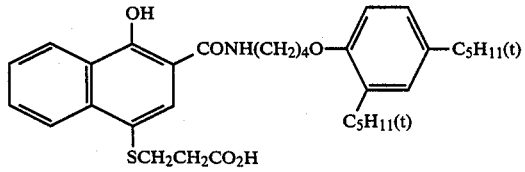

-continued
C-(18)
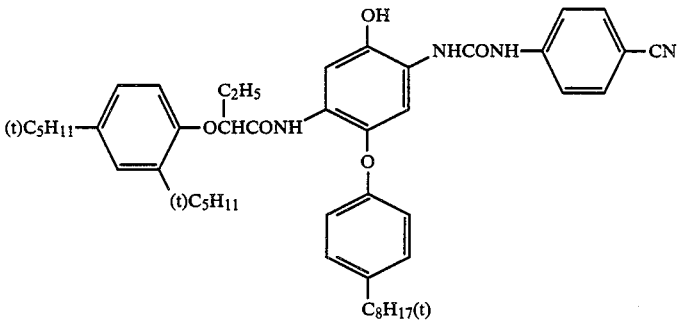
C-(19)
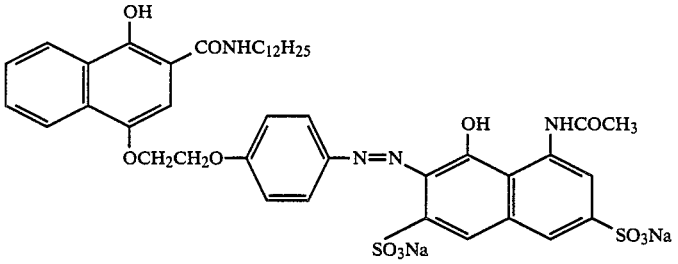
C-(20)
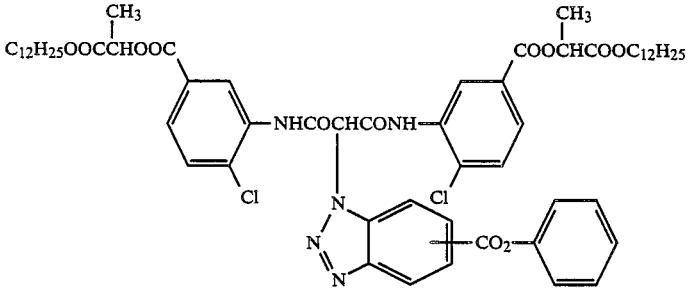
C-(21)
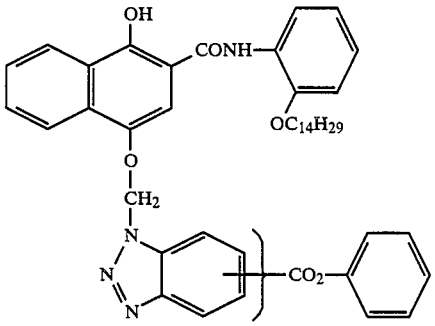
C-(22)
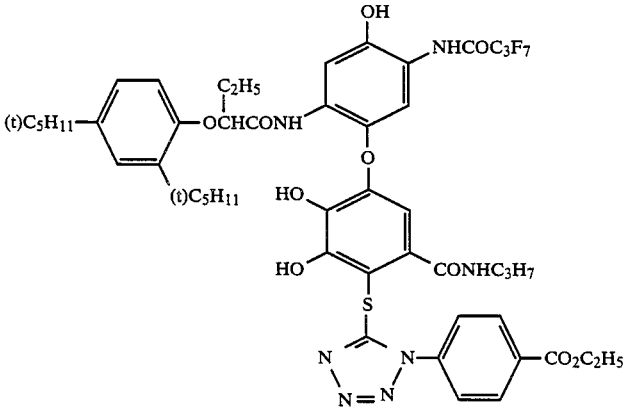

-continued
C-(23)
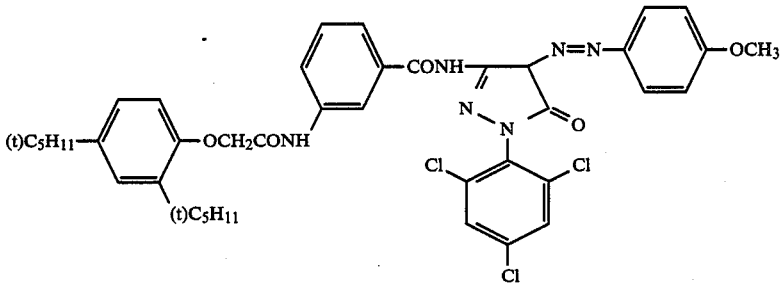
C-(24)
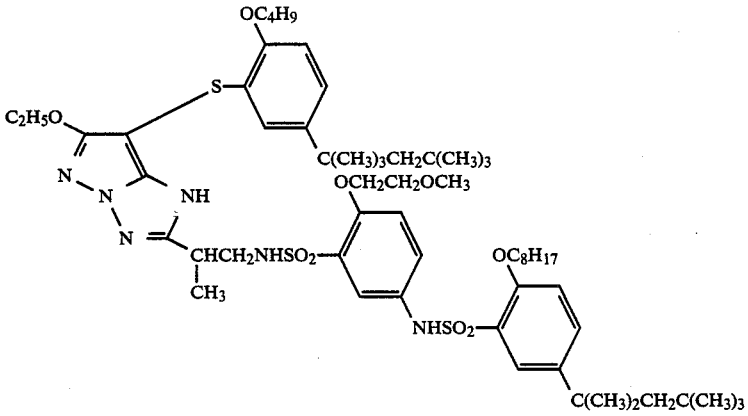
C-(25)
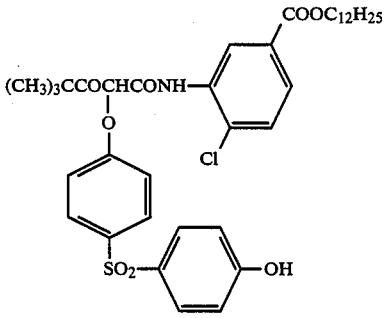
C-(26)
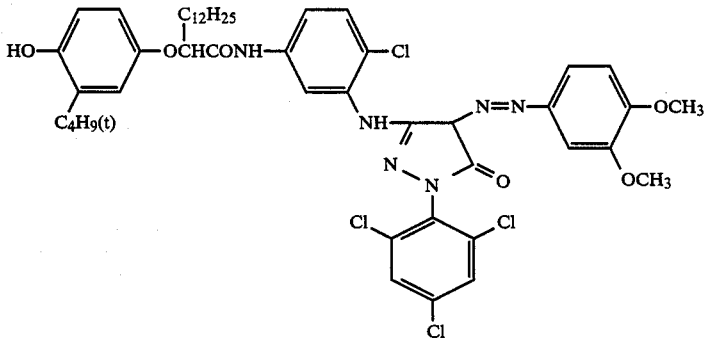

-continued
C-(27)
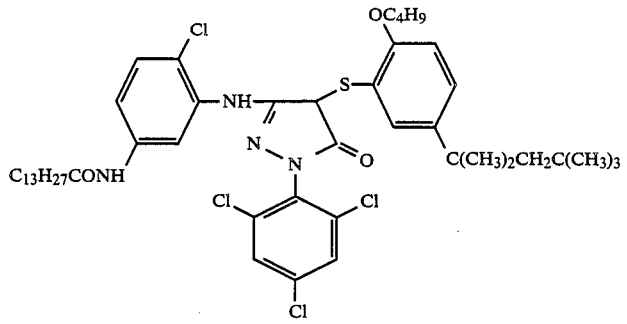
C-(28)
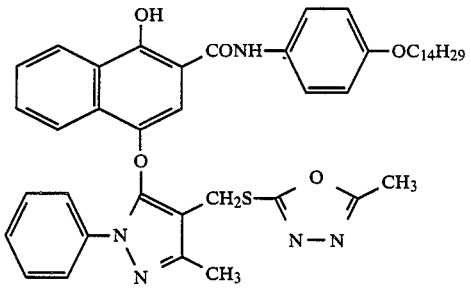
C-(29)
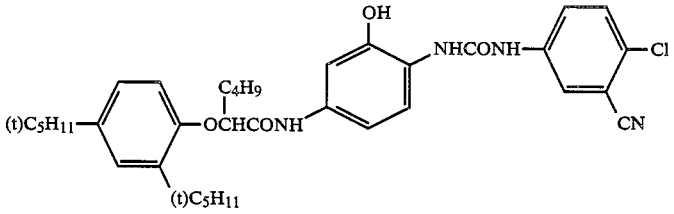
C-(30)
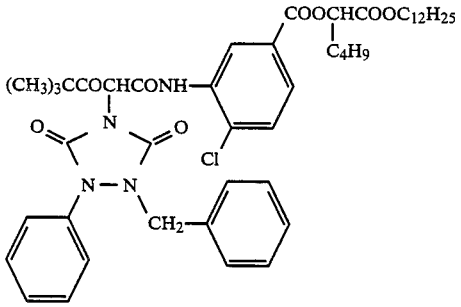
C-(31)
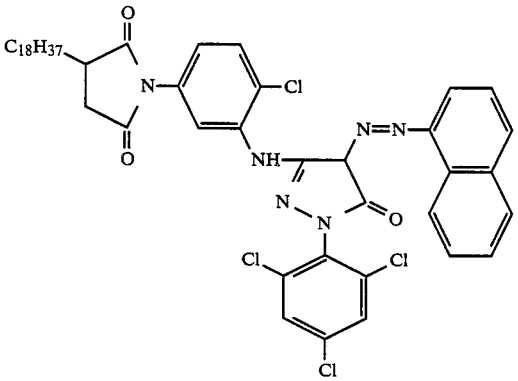

-continued
C-(32)
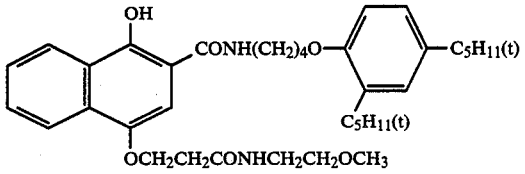
C-(33)
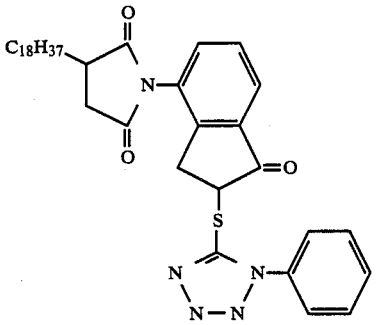
C-(34)
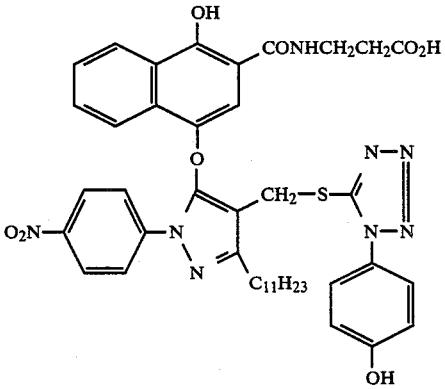
C-(35)
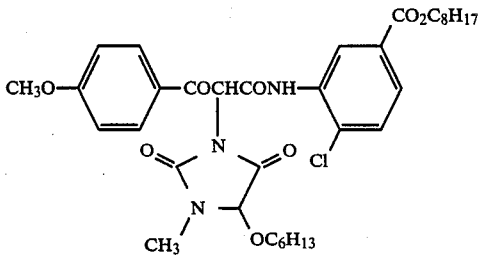
C-(36)
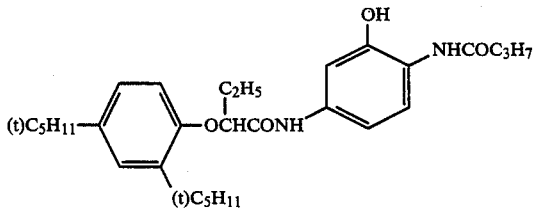

-continued
C-(37)
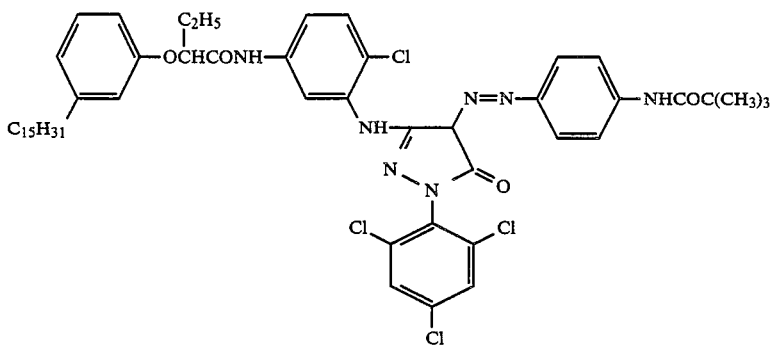
C-(38)
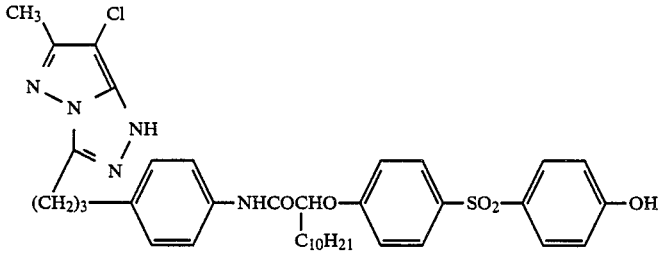
C-(39)
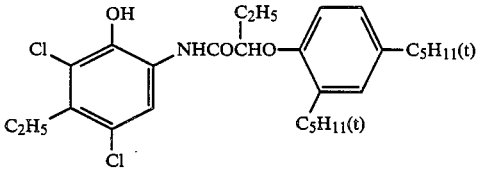
C-(40)
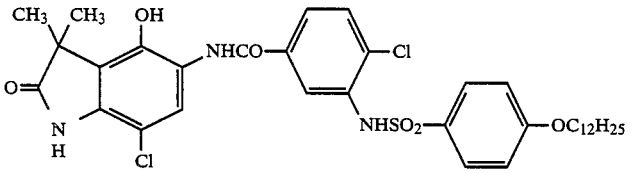
C-(41)
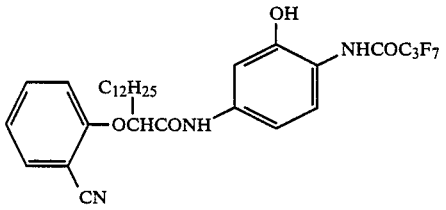
C-(42)
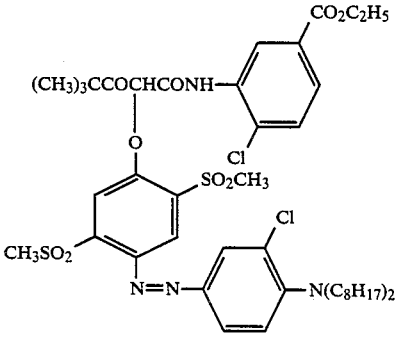

-continued
C-(43)
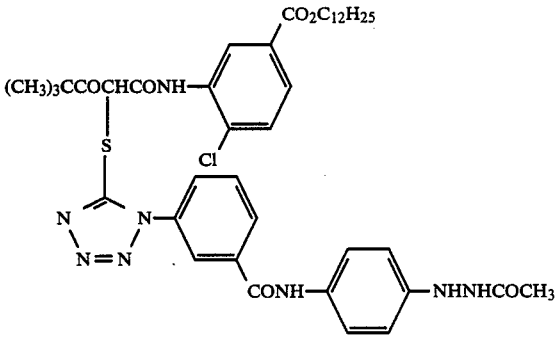
C-(44)
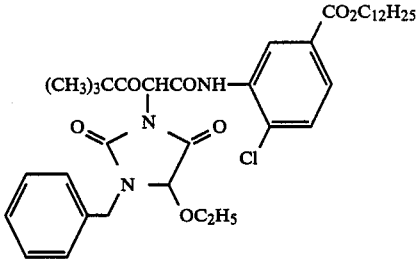
C-(45)
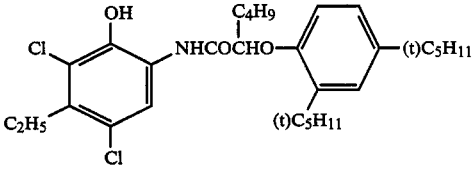
C-(46)
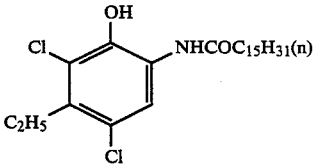
C-(47)
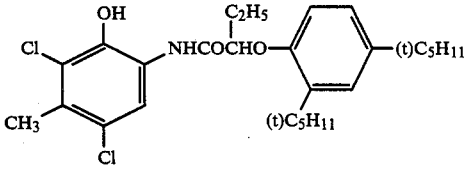
C-(48)
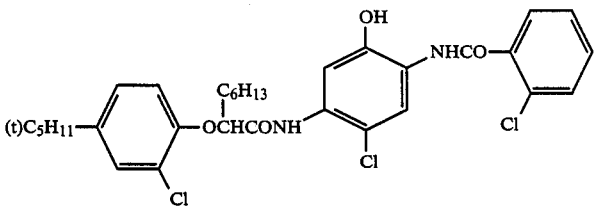
C-(49)
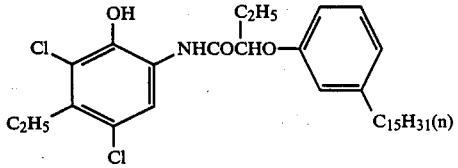

-continued
C-(50)
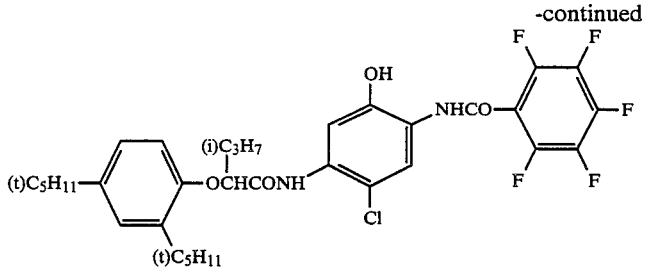
C-(51)
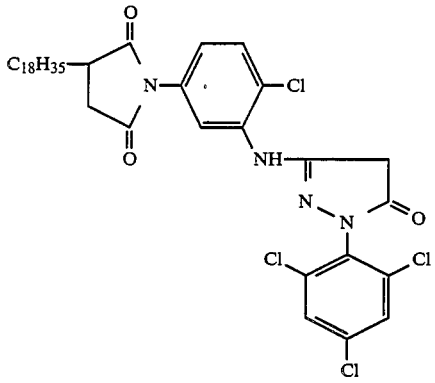
C-(52)
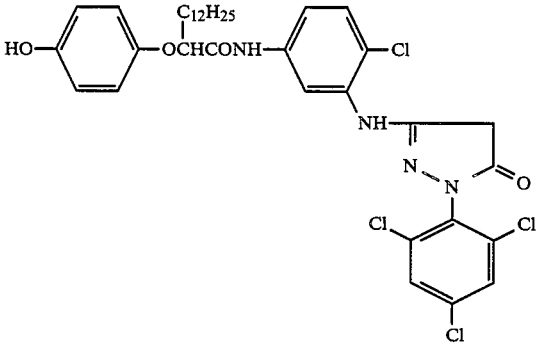
C-(53)
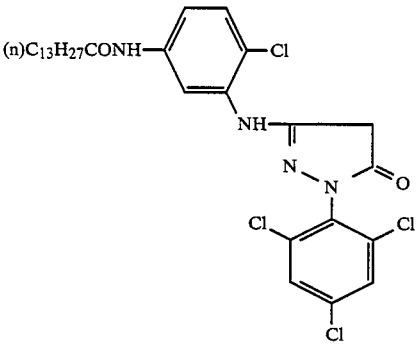
C-(54)
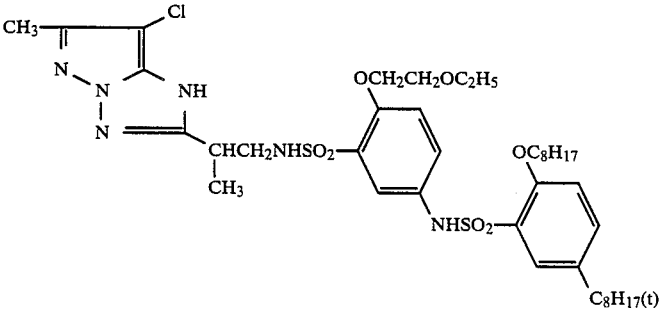

-continued
C-(55)
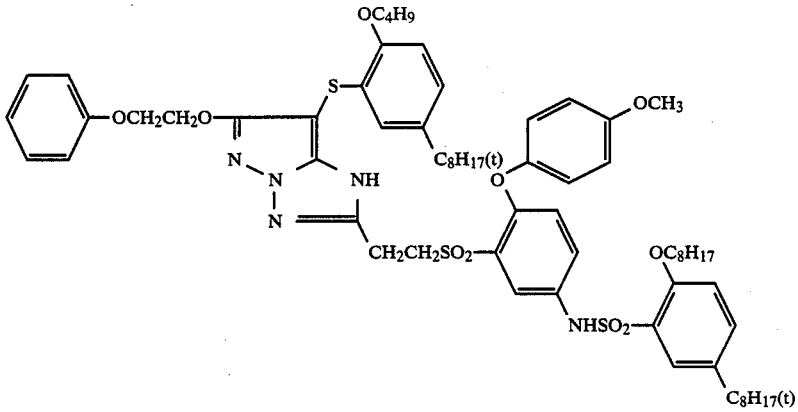
C-(56)
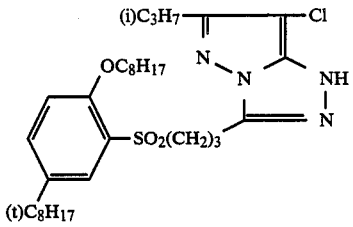
C-(57)
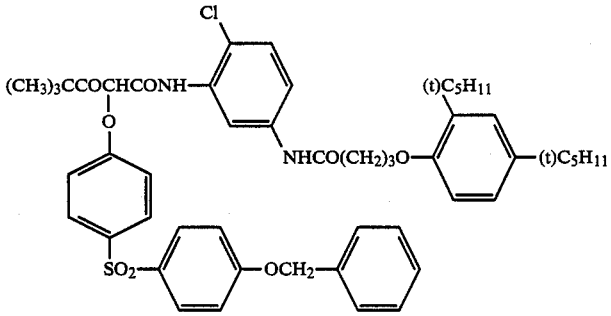
C-(58)
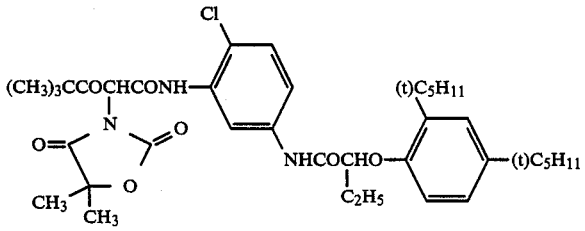
C-(59)
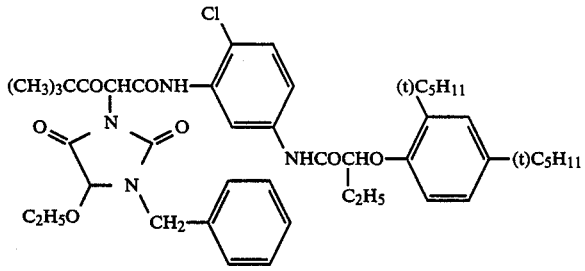
Photographic additives other than the above-mentioned couplers are described in Research Disclosures, and the related parts are shown in the following Table.
| Additives | RD 17643 | RD 18716 |
|---|---|---|
| 1. Chemical sensitizer | p. 23 | p. 648, right column |
| 2. Sensitivity elevating agent | | " |
| 3. Spectral sensitizer, | pp. 23–24 | from p. 648, |

-continued

| Additives | RD 17643 | RD 18716 |
|---|---|---|
| Super color sensitizer | | right column to p. 649, left column |
| 4. Brightening agent | p. 24 | |
| 5. Anti-foggant, Stabilizer | pp. 24–25 | p. 649, right column |
| 6. Light absorbent, Filter dye, UV absorbent | pp. 25–26 | from p, 649, right column to p. 650, left column |
| 7. Stain preventing agent | p. 25, right column | p. 650, from left to right column |
| 8. Color image stabilizer | p. 25 | |
| 9. Hardener | p. 26 | p. 651, left column |
| 10. Binder | p. 26 | " |
| 11. Plasticizer, Lubricant | p. 27 | p. 650, right column |
| 12. Coating assistant, | pp. 26–27 | " |
| Antistatic agent | p. 27 | " |

The couplers for use in the present invention can be introduced into the photographic light-sensitive materials by various known dispersion methods. Examples of the dispersion methods include a solid dispersion method, an alkali dispersion method, a latex dispersion method and an oil-in-water dispersion method. The latter two methods are preferred; the latter method is especially preferred. According to the oil-in-water dispersion method where substantially water-insoluble couplers and other photographic additives are introduced into photographic light-sensitive materials, the couplers and/or additives together are first dissolved in a solution comprising either a high boiling point organic solvent having a boiling point of at least 175° C. or an auxiliary solvent having a low boiling point or in a solvent solution comprising a mixture of both types of solvents. The resulting solution is finely dispersed in an aqueous medium such as water or gelatin-aqueous solution in the presence of a surfactant. Examples of the high boiling point organic solvents are described in U.S. Pat. No. 2,322,027. The dispersion may be accompanied by phase inversion. The auxiliary solvent, if used, may be removed or reduced in amount by distillation, noodle washing or ultrafiltration prior to coating the resulting emulsion onto a support.

Specific examples of the high boiling point organic solvents include, in addition to the compounds of the formula (I), phthalic acid esters (e.g., dibutyl phthalate, dicyclohexyl phthalate, di-2-ethylhexyl phthalate, decyl phthalate); phosphoric acid or phosphonic acid esters (e.g., triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphate.); benzoic acid esters (e.g., 2-ethylhexyl benzoate, dodecyl benzoate, 2-ethylhexyl-p-hydroxybenzoate); amides (e.g., diethyldodecanamide, N-tetradecylpyrrolidone, etc.); alcohols or phenols (e.g., isostearyl alcohol, 2,4-di-tert-amylphenol); aliphatic carboxylic acid esters (e.g., dioctyl azelate, glycerol tributyrate, isostearyl lactate, trioctyl citrate); aniline derivatives (e.g., N,N-dibutyl-2-butoxy-5-tertoctylaniline) and hydrocarbons (e.g., paraffin, dodecylbenzene, diisopropylnaphthalene). One or more of these can be used in combination with at least one compound of the formula (I). The auxiliary solvent that can be used consists of organic solvents having a boiling point of about 30° C. or higher, preferably from about 50° C. to about 160° C. Specific examples thereof are ethyl acetate, butyl acetate, ethyl propionate, methyl ethyl ketone, cyclohexanone, 2-ethoxyethyl acetate and dimethylformamide.

Latex dispersion means and methods and specific examples of latex to be used for impregnation are described in U.S. Pat. No. 4,199,363 and West German Patent Application (OLS) Nos. 2,541,274 and 2,541,230, the disclosures of which are incorporated herein by reference.

Examples of supports which are suitable for use in the present invention are described in the aforesaid *Research Disclosure* No. 17643, page 28 and ibid., No, 18716, from page 647, right-hand column to page 648, left-hand column.

Preferred silver halide to be contained in the photographic emulsion layers in the photographic light-sensitive materials of the present invention are silver iodobromide, silver iodochloride or silver iodochlorobromide, containing silver iodide in an amount of about 30 mol% or less. An especially preferred silver halide is silver iodobromide containing silver iodide in an amount of from about 2 mol% to about 25 mol%.

The silver halide grains in the photographic emulsion may have a regular crystal form such as a cubic, octahedral or tetradecahedral from, or an irregular crystal form such as a spherical or tabular form, or may also have a crystal defect such as twin plane, or may have a composite crystal form comprising the said crystal forms.

The silver halide grains may be fine grains having a grain size of about 0.2$\mu$ or less or may be large grains having a grain size, as a diameter of the project area, of up to about 10$\mu$. The emulsion may be either a polydispersed emulsion or a monodispersed emulsion.

The silver halide photographic emulsions for use in the present invention can be prepared by various methods, for example, those described in *Research Disclosure* No. 17643 (December, 1978), pages 22–23, "I. Emulsion Preparation and Types"; ibid., No. 18716 (November, 1979), page 648; P. Glafkides, *Chemie et Phisique Photographique* (published by Paul Montel, 1967); G. F. Duffin, *Photographic Emulsion Chemistry* (published by Focal Press, 1966) and V. L. Zelikmann et al, *Making and Coating Photographic Emulsion* (published by Focal Press, 1964).

The monodispersed emulsions described in U.S. Pat. Nos. 3,574,628 and 3,655,394 and British Pat. No. 1,413,748 are also preferred.

In addition, tabular grains having an aspect ratio of about 5 or more can also be used in the present invention. Tabular grains can easily be prepared by the methods described in Gutoff, *Photographic Science and Engineering,* Vol. 14, pages 248–257 (1970); U.S. Pat. Nos. 4,434,226, 4,414,310, 4,433,048 and 4,439,520 and British Pat. No. 2,112,157.

The crystal structure of the silver halide grains may be uniform throughout the whole grain, or the inside part and the outside part of the crystal structure may have different halogen compositions. The grain may also have a layered crystal structure. Different silver halide compositions may be joined by epitaxial junction in one grain. In addition, the silver halide grain may have a multiphase junction structure, as joined with other compounds than silver halide, such as silver rhodanide and lead oxide.

Further, a mixture comprising grains of various crystal forms can also be used in the present invention.

The silver halide emulsions for use in the present invention are generally physically ripened, chemically ripened or spectrally sensitized. Additive for use in such ripening and sensitizing steps are described in *Research Disclosure* Nos. 17643 and 18716.

The color photographic materials of the present invention can be developed by conventional methods such as those described in the aforesaid *Research Disclosure* No. 17643, pages 28–29 and ibid., No. 18716, page 651, from left to right column.

The color photographic materials of the present invention, after development, bleach-fixation or fixation, generally are subjected to either rinsing with water or a stabilization procedure.

The rinsing step is generally carried out by countercurrent system using two or more rinsing tanks, for economy of water. As the stabilization process, the multistage countercurrent stabilization described in Japanese Patent Application (OPI) No. 8543/82 is typical, and the process can be performed in place of the water-rinsing step.

When the photographic light-sensitive materials of the present invention are black-and-white silver halide photographic materials, these can be developed by the methods described in *Research Disclosure,* Vol. 176, No. 17643, pages 28 to 29, ibid., Vol. 187, No. 18716, page 651, left and right columns, etc.

The photographic light-sensitive materials of the present invention which are color photographic materials include, for example, color negative films, color reversal films, color papers, color reversal papers, color negative films for movies and color positive films for movies.

The photographic light-sensitive materials of the present invention which are black-and-white photographic materials include, for example, black-and-white negative photographic materials, X-ray photographic materials, printing photographic materials and black-and-white photographic papers.

As mentioned above, the silver halide photographic materials of the present invention are characterized by the excellent solubility and dispersibility of the substantially water-insoluble photographic additives, the excellent long-term storability of the dispersions of said additives and the excellent color-forming property and the latent image storability.

These attributes can be attained only by the use for the specific high boiling point organic solvents of the present invention, which are surprinsing and unexpected.

The following examples are intended to illustrate the present invention but to limit it in any way.

EXAMPLE 1

Various kinds of emulsified dispersions were prepared, whereupon the coupler, the coupler solvent and the ratio of coupler/coupler solvent were varied as shown in Table 1 below. The dispersions were coated onto a polyethylene-coated paper support to form a first layer, and a protective layer was coated thereover as the second layer. Sample Nos. 1 to 27 were obtained.

| First Layer: Green-sensitive Emulsion Layer | |
|---|---|
| Silver iodobromide as spectrally sensitized with green sensitizing dye (*14) (silver iodide 3.5 mol %, grain size 0.9μ) | 0.20 g/m$^2$ as Ag |
| Gelatin | 1.60 g/m$^2$ |
| Magenta coupler (See Table 1) | 0.20 g/m$^2$ |
| Anti-fading agent (*16) | 0.20 g/m$^2$ |
| Stain preventing agent (*17) | 0.02 g/m$^2$ |
| Stain preventing agent (*18) | 0.002 g/m$^2$ |
| Coupler solvent (See Table 1) | See Table 1 |
| Second Layer: Protective Layer | |
| Gelatin | 2.00 g/m$^2$ |
| Gelatin hardener (*26) | 0.11 g/m$^2$ |

These samples were exposed in a conventional manner and then processed as follows:

| Processing Steps | | |
|---|---|---|
| First developement (Black-and-white development) | 38° C. | 1 min 15 sec |
| Rinsing with water | 38° C. | 1 min 30 sec |
| Reversal exposure | 100 lux or more | 1 sec or more |
| Color development | 38° C. | 2 min 15 sec |
| Rinsing with water | 38° C. | 45 sec |
| Bleach-fixation | 38° C. | 2 min 00 sec |
| Rinsing with water | 38° C. | 2 min 15 sec |

The compositions of the processing solutions used were as follows:

| First Developer | |
|---|---|
| Nitrilo-N,N,N—trimethylenephosphonic acid pentasodium salt | 0.6 g |
| Diethylenetriaminepentaacetic acid pentasodium salt | 4.0 g |
| Potassium sulfite | 30.0 g |
| Potassium thiocyanate | 1.2 g |
| Potassium carbonate | 35.0 g |
| Hydroquinone-monosulfonate potassium salt | 25.0 g |
| Diethylene glycol | 15.0 ml |
| 1-Phenyl-4-hydroxymethyl-4-methyl-3-pyrazolidone | 2.0 g |
| Potassium bromide | 0.5 g |
| Potassium iodide | 5.0 mg |
| Water to make | 1 l (pH 9.70) |

TABLE 1

| Sample No. | Coupler | Coupler Solvent | Coupler/Coupler Solvent (g/g) | Dispersion Stability: Dispersibility | Dispersion Stability: Stability | Latent Image Stability ΔS0.7 | Remarks |
|---|---|---|---|---|---|---|---|
| 1 | C-(53) | O-1 | 0.5 | 0.233 | 1.11 | 0.10 | Comparison |
| 2 | " | O-2 | " | 0.220 | 1.10 | 0.11 | " |
| 3 | " | O-3 | " | 0.251 | 1.13 | 0.09 | " |
| 4 | " | S-1 | " | 0.232 | 1.10 | 0.01 | Invention |
| 5 | " | S-2 | " | 0.235 | 1.09 | 0.02 | " |
| 6 | " | O-4 | " | 0.309 | 1.18 | 0.12 | Comparison |
| 7 | " | O-5 | " | 0.301 | 1.15 | 0.11 | " |
| 8 | " | O-6 | " | 0.332 | 1.30 | 0.10 | " |
| 9 | " | O-7 | " | 0.325 | 1.25 | 0.09 | " |

TABLE 1-continued

| Sample No. | Coupler | Coupler Solvent | Coupler/ Coupler Solvent (g/g) | Dispersion Stability Dispers-ibility | Dispersion Stability Stability | Latent Image Stability ΔS0.7 | Remarks |
|---|---|---|---|---|---|---|---|
| 10 | C-(9) | O-1 | " | 0.350 | 1.21 | 0.15 | " |
| 11 | " | O-2 | " | 0.347 | 1.20 | 0.16 | " |
| 12 | " | O-3 | " | 0.340 | 1.25 | 0.14 | " |
| 13 | " | S-1 | " | 0.349 | 1.21 | 0.03 | Invention |
| 14 | " | S-2 | " | 0.350 | 1.22 | 0.03 | " |
| 15 | " | O-4 | " | 0.363 | 1.28 | 0.13 | Comparison |
| 16 | " | O-5 | " | 0.360 | 1.26 | 0.14 | " |
| 17 | C-(9) | O-6 | 0.5 | 0.380 | 1.31 | 0.13 | Comparison |
| 18 | " | O-7 | " | 0.378 | 1.30 | 0.13 | " |
| 19 | " | O-1 | 1.0 | 0.253 | 1.13 | 0.09 | " |
| 20 | " | O-2 | " | 0.251 | 1.13 | 0.09 | " |
| 21 | " | O-3 | " | 0.280 | 1.18 | 0.08 | " |
| 22 | " | S-1 | " | 0.290 | 1.15 | 0.00 | Invention |
| 23 | " | S-2 | " | 0.289 | 1.16 | 0.00 | " |
| 24 | " | O-4 | " | 0.298 | 1.20 | 0.08 | Comparison |
| 25 | " | O-5 | " | 0.290 | 1.19 | 0.08 | " |
| 26 | " | O-6 | " | 0.306 | 1.24 | 0.07 | " |
| 27 | " | O-7 | " | 0.298 | 1.22 | 0.08 | |

The latent image storability and the dispersion stability of the samples were tested as mentioned below.

(1) Dispersion Stability:

The dispersion was stored at 40° C. for 72 hours, and the turbidity ($D_{500}$) of the fresh sample (immediately after emulsification) and that of the aged sample (after 72 hrs. storage) were measured by a spectrophotometer. The dispersability and stability were calculated by the following formulae.

Dispersibility = Turbidity of fresh sample immediately after emulsified $$\text{Stability} = \frac{\text{Turbidity of Aged Sample}}{\text{Turbidity of Fresh Sample}}$$

(2) Latent Image Storability:

The sensitivity difference between the two samples wherein after exposure, one sample was stored under the conditions of 35° C. and 65% RH for 10 days or another sample was stored in a freezer was observed.

$\Delta S_{0.7}$ = (sensitivity at density 0.7 of the sample stored in freezer) − (sensitivity at density 0.7 of the sample stored under 35° C., 65% RH, for 10 days)

O-1

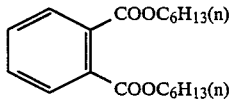

(described in Japanese Patent Application (OPI) No. 149348/84)

O-2

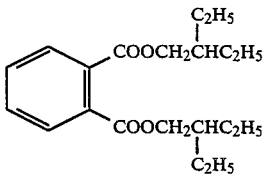

(described in Japanese Patent Application (OPI) No. 109053/84)

O-3

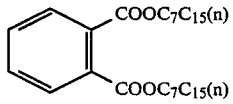

(described in Japanese Patent Application (OPI) No. 91325/79)

-continued

O-4

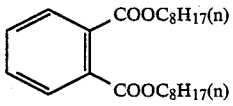

(described in Japanese Patent Application (OPI) No. 171953/84)

O-5

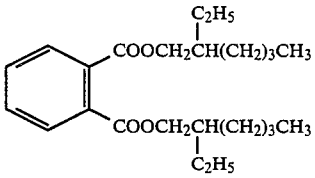

(described in Japanese Patent Application (OPI) No. 171953/84)

O-6

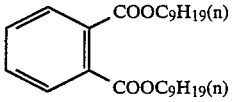

(described in Japanese Patent Application (OPI) No. 149348/84)

O-7

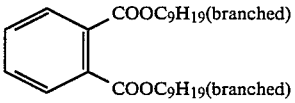

(described in Japanese Patent Application (OPI) No. 149348/84)

The results of Table 1 indicate that the organic solvents of the formula (I) exhibit excellent dispersibility properties as the turbidity of the fresh samples (immediately after emulsified) was low and also exhibit excellent dispersion stability as the variation of the turbidity in the aged samples was also small.

In addition, the latent image storability of the samples formed using the organic solvents of the formula (I) was also excellent.

EXAMPLE 2

A twelve-layered color photographic material was prepared, on a paper support, both surfaces of which were coated with polyethylene. The polyethylene on the side of the first layer contained titanium white as white pigment and a slight amount of ultramarine as a bluish dye.

The compositions of the layers were as follows.

| | |
|---|---|
| First Layer: Gelatin Layer | |
| Gelatin | 1.30 g/m$^2$ |
| Second Layer: Antihalation Layer | |
| Black colloidal silver | 0.10 g/m$^2$ as Ag |
| Gelatin | 0.70 g/m$^2$ |
| Third Layer: Low Sensitive Red-sensitive Emulsion Layer | |
| Silver iodobromide spectrally sensitized with red sensitizing dyes (*1/*2 = 1/2 by weight)(silver iodide 5.0 mol %, mean grain size 0.4μ) | 0.15 g/m$^2$ as Ag |
| Gelatin | 1.00 g/m$^2$ |
| Cyan coupler (*3) | 0.14 g/m$^2$ |
| Cyan coupler (*4) | 0.07 g/m$^2$ |
| Anti-fading agents (*5/*6/*7 = 1/2/2.5 by weight) | 0.10 g/m$^2$ |
| Coupler solvents (*8/*9 = 2/1 by weight) | 0.06 g/m$^2$ |
| Fourth Layer: High Sensitive Red-sensitive Emulsion Layer | |
| Silver iodobromide emulsion spectrally sensitized with red sensitizing dyes (*1/*2 = 1/2 by weight) (silver iodide 6.0 mol %, meangrain size 0.7μ) | 0.15 g/m$^2$ as Ag |
| Gelatin | 1.00 g/m$^2$ |
| Cyan coupler (*3) | 0.20 g/m$^2$ |
| Cyan coupler (*4) | 0.10 g/m$^2$ |
| Anti-fading agents (*5/*6/*7 = 1/2/2.5 by weight) | 0.15 g/m$^2$ |
| Coupler solvents (*8/*9 = 2/1 by weight) | 0.10 g/m$^2$ |
| Fifth Layer: Interlayer | |
| Black colloidal silver | 0.02 g/m$^2$ as Ag |
| Gelatin | 1.00 g/m$^2$ |
| Color mixing preventing agent (*10) | 0.08 g/m$^2$ |
| Color mixing preventing agent solvents (*11/*12 = 1/1 by weight) | 0.16 g/m$^2$ |
| Polymer latex (*13) | 0.10 g/m$^2$ |
| Sixth Layer: Low Sensitive Green-sensitive Emulsion Layer | |
| Silver iodobromide emulsion spectrally sensitized with green sensitizing dye (*14) (silver iodide 2.5 mol %, grain size 0.4μ) | 0.10 g/m$^2$ as Ag |
| Gelatin | 0.80 g/m$^2$ |
| Magenta coupler (*15) | 0.10 g/m$^2$ |
| Anti-fading agent (*16) | 0.10 g/m$^2$ |
| Stain preventing agent (*17) | 0.01 g/m$^2$ |
| Stain preventing agent (*18) | 0.001 g/m$^2$ |
| Coupler solvent (*11/*19 = 1/1 by weight) | 0.15 g/m$^2$ |
| Seventh Layer: High Sensitive Green-sensitive Emulsion Layer | |
| Silver iodobromide emulsion spectrally sensitized with green sensitizing dye (*14) (silver iodide 3.5 mol %, grain size 0.9μ) | 0.10 g/m$^2$ as Ag |
| Gelatin | 0.80 g/m$^2$ |
| Magenta coupler (*15) | 0.10 g/m$^2$ |
| Anti-fading agent (*16) | 0.10 g/m$^2$ |
| Stain preventing agent (*17) | 0.01 g/m$^2$ |
| Stain preventing agent (*18) | 0.001 g/m$^2$ |
| Coupler solvents (*11/*19 = 1/1 by weight) | 0.15 g/m$^2$ |
| Eighth Layer: Yellow Filter Layer | |
| Yellow colloidal silver | 0.20 g/m$^2$ as Ag |
| Gelatin | 1.00 g/m$^2$ |
| Color mixing preventing agent (*10) | 0.06 g/m$^2$ |
| Color mixing preventing agent solvent (*11/*12 = 1/1 by weight) | 0.15 g/m$^2$ |
| Polymer latex (*13) | 0.10 g/m$^2$ |
| Ninth Layer: Low Sensitive Blue-sensitive Emulsion Layer | |
| Silver iodobromide emulsion spectrally sensitized with blue sensitizing dye (*20) (silver iodide 2.5 mol %, grain size 0.5μ) | 0.15 g/m$^2$ as Ag |
| Gelatin | 0.50 g/m$^2$ |
| Yellow coupler (*21) | 0.20 g/m$^2$ |
| Stain preventing agent (*18) | 0.001 g/m$^2$ |
| Coupler solvent (*9) | 0.05 g/m$^2$ |

-continued

| | |
|---|---|
| Tenth Layer: High Sensitive Blue-sensitive Emulsion Layer | |
| Silver iodobromide emulsion spectrally sensitized with blue sensitizing dye (*20) (silver iodide 2.5 mol %, grain size 1.2μ) | 0.25 g/m² as Ag |
| Gelatin | 1.00 g/m² |
| Yellow coupler (*21) | 0.40 g/m² |
| Stain preventing agent (*18) | 0.002 g/m² |
| Coupler solvent (*9) | 0.10 g/m² |
| Eleventh Layer: Ultraviolet Absorbing Layer | |
| Gelatin | 1.50 g/m² |
| Ultraviolet absorbents (*22/*6/*7 = 1/0.2/1 by weight) | 1.00 g/m² |
| Color mixing preventing agent (*23) | 0.06 g/m² |
| Color mixing preventing agent solvent (*9) | 0.15 g/m² |
| Anti-irradiation dye (*24) | 0.02 g/m² |
| Anti-irradiation dye (*25) | 0.02 g/m² |
| Twelfth Layer: Protective Layer | |
| Silver chlorobromide fine grains (silver chloride 97 mol %, mean grain size 0.2μ) | 0.07 g/m² as Ag |
| Gelatin | 1.50 g/m² |
| Gelatin hardener (*26) | 0.17 g/m² |

(*1) 5,5'-Dichloro-3,3'-di(3-sulfobutyl)-9-ethylthiacarbocyanine Na—salt
(*2) Triethylammonium-3-[2-{2-[3-(3-sulfopropyl)-naphtho(1,2-d)-thiazolin-2-indenemethyl]-1-butyl}-3-naphtho(1,2-d)-thiazolino]propane sulfonate
(*3) 2-[α-(2,4-di-t-Amylphenoxy)hexanamido]-4,6-dichloro-5-ethylphenol
(*4) 2-[2-Chlorobenzamido]-4-chloro-5-[α-(2-chloro-4-t-amylphenoxy)octanamido]phenol
(*5) 2-(2-Hydroxy-3-sec-5-t-butylphenyl)benzotriazole
(*6) 2-(2-Hydroxy-5-t-butylphenyl)benzotriazole
(*7) 2-(2-Hydroxy-3,5-di-t-butylphenyl)-6-chlorobenzotriazole
(*8) Di(2-ethylhexyl) phthalate
(*9) Trinonyl phosphate
(*10) 2,5-Di-t-octylhydroquinone
(*11) Tricresyl phosphate
(*12) Dibutyl phthalate
(*13) Polyethyl acrylate
(*14) 5,5'-Diphenyl-9-ethyl-3,3'-disulfopropyloxacarbocyanine Na—salt
(*15) 7-Chloro-6-methyl-2-[2-{2-octyloxy-5-(2-octyloxy-5-t-octylbenzene-sulfonamido)benzenesulfonamido}-1-methylethyl]-1H—pyrazolo[1,5-b][1,2,4]triazole
(*16) 3,3,3',3'-Tetramethyl-5,6,5',6'-tetrapropoxy-1,1'-bisspiroindane
(*17) 3-(2-Ethylhexyloxycarbonyloxy)-1-(3-hexadecyloxyphenyl)-2-pyrazoline
(*18) 2-Methyl-5-t-octylhydroquinone
(*19) Trioctyl phosphate
(*20) Triethylammonium 3-[2-(3-benzylrhodanin-5-ylidene)-3-benzoxazolinyl]propane sulfonate
(*21) α-Pivaloyl-α-[(2,4-dioxo-1-benzyl-5-ethoxyhydantoin-3-yl)-2-chloro-5-(α-2,4-di-t-amylphenoxy)-nutanamido]acetanilide
(*22) 5-Chloro-2-(2-hydroxy-3-t-butyl-5-t-octyl)phenylbenzotriazole
(*23) 2,5-Di-sec-octylhydroquinone (*24)
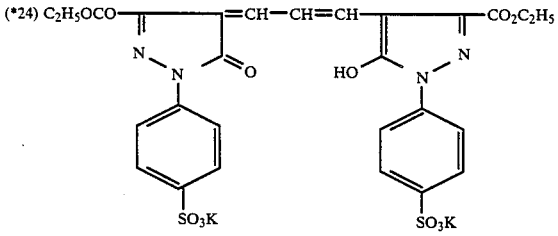

(*25)
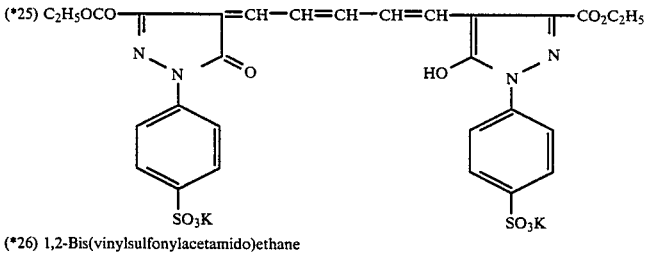

(*26) 1,2-Bis(vinylsulfonylacetamido)ethane

The sample thus prepared was designated as Sample No. 101.

Next, sample Nos. 102 to 110 were prepared in the same manner as the preparation of the Sample No. 101, except that the coupler solvents and the color mixing preventing agent solvents in the third to eleventh layers were varied as shown in Table 2 below.

These samples were exposed in a conventional manner and then processed in the same manner as Example 1. The latent image storability was ested for each sample. The results obtained are shown in Table 2.

The results of Table 2 indicate that the organic solvents of the formula (I) impart excellent latent image storability to the photographic material.

TABLE 2

| Sample No. | Organic Solvent | Latent Image Storability BL $S_{0.7}$ | GL $S_{0.7}$ | RL $S_{0.7}$ | Remarks |
|---|---|---|---|---|---|
| 101 | — | 0.04 | 0.04 | 0.04 | Comparison |
| 102 | O-1 | 0.06 | 0.07 | 0.07 | " |
| 103 | O-2 | 0.05 | 0.04 | 0.05 | " |
| 104 | O-3 | 0.03 | 0.03 | 0.04 | " |
| 105 | S-1 | 0.00 | 0.00 | 0.00 | Invention |
| 106 | S-2 | 0.00 | 0.00 | 0.00 | " |
| 107 | O-4 | 0.03 | 0.04 | 0.03 | Comparison |
| 108 | O-5 | 0.03 | 0.03 | 0.03 | " |
| 109 | O-6 | 0.02 | 0.02 | 0.03 | " |
| 110 | O-7 | 0.03 | 0.02 | 0.03 | " |

EXAMPLE 3

A multilayered photographic paper (Sample No. 201) was prepared by forming the layers having the compositions shown below on a paper support, both surfaces of which were coated with polyethylene. The coating compositions for the layers were prepared as follows.

Coating Composition for First Layer:

27.2 cc of ethyl acetate and 7.7 cc (8.0 g) of High Boiling Point Solvent (Solv-1) were added to Yellow Coupler (C-58) (10.2 g), Yellow Coupler (C-59) (9.1 g) and 4.4 g of Color Image Stabilizer (Cpd-1) and dissolved, and the resulting solution was dispersed by emulsification in 185 cc of an aqueous 10 wt% gelatin solution containing 8 cc of a 10 wt% sodium dodecylbenzenesulfonate solution. The emulsified dispersion thus prepared was blended and dissolved in Emulsions EM1 and EM2 mentioned below, whereupon the gelatin concentration was adjusted as shown below, to provide the coating composition for the first layer. Coating compositions for the second layer to the seventh layer were prepared in the same manner as in the first layer. As a gelatin hardening agent for each layer, 1-hydroxy-3,5-dichloro-s-triazine sodium salt was used.

The compositions of the layers were as follows.

| | |
|---|---|
| Support: | |
| Polyethylene-coated Paper, containing white pigment ($TiO_2$) and blueish dye in the polyethylene on the side of the first layer. | |
| First Layer: Blue sensitive Emulsion Layer | |
| Monodispersed silver chlorobromide emulsion (EM1) spectrally sensitized with sensitizing dye (ExS-1) | 0.13 g/m² as Ag |
| Monodispersed silver chlorobromide emulsion (EM2) spectrally sensitized with sensitizing dye (ExS-1) | 0.13 g/m² as Ag |
| Gelatin | 1.86 g/m² |
| Yellow coupler (C-58) | 0.44 g/m² |
| Yellow coupler (C-59) | 0.39 g/m² |
| Coupler image stabilizer (Cpd-1) | 0.19 g/m² |
| Solvent (Solv-1) | 0.35 g/m² |
| Second Layer: Color Mixing Preventing Layer | |
| Gelatin | 0.99 g/m² |
| Color mixing preventing agent (Cpd-2) | 0.08 g/m² |
| Third Layer: Green-sensitive Emulsion Layer | |
| Monodispersed silver chlorobromide emulsion (EM3) spectrally sensitized with sensitizing dyes (ExS-2/ExS-3 = 1:0.2 by weight) | 0.05 g/m² as Ag |
| Monodispersed silver chlorobromide emulsion (EM4) spectrally sensitized with sensitizing dyes (ExS-2/ExS-3 = 1:0.2 by weight) | 0.11 g/m² as Ag |
| Gelatin | 1.80 g/m² |
| Magenta coupler (C-9) | 0.38 g/m² |
| Color image stabilizer (Cpd-3) | 0.20 g/m² |
| Solvent (Solv-2) | 0.12 g/m² |
| Solvent (Solv-3) | 0.25 g/m² |
| Fourth Layer: Ultraviolet Absorbing Layer | |
| Gelatin | 1.60 g/m² |
| Ultraviolet absorbents (Cpd-4/Cpd-5/Cpd-6 = 3/2/6 by weight) | 0.70 g/m² |
| Color mixing preventing agent (Cpd-7) | 0.05 g/m² |
| Solvent (Solv-4) | 0.27 g/m² |
| Fifth Layer: Red-sensitive Emulsion Layer | |
| Monodispersed silver chlorobromide emulsion (EM5) spectrally sensitized with sensitizing dyes (ExS-4/ExS-5 = 1/50 by weight) | 0.07 g/m² as Ag |
| Monodispersed silver chlorobromide emulsion (EM6) spectrally sensitized with sensitizing dyes (ExS-4/ExS-5 = 1/50 by weight) | 0.16 g/m² as Ag |
| Gelatin | 0.92 g/m² |
| Cyan coupler (C-49) | 0.32 g/m² |
| Color image stabilizers (Cpd-5/Cpd-6/Cpd-8 = 3/4/2 by weight) | 0.17 g/m² |
| Polymer for dispersion (Cpd-9) | 0.28 g/m² |
| Solvent (Solv-2) | 0.20 g/m² |
| Sixth Layer: Ultraviolet Absorbing Layer | |
| Gelatin | 0.54 g/m² |
| Ultraviolet absorbents (Cpd-4/Cpd-6/Cpd-8 = 1/5/3 by weight) | 0.21 g/m² |
| Solvent (Solv-2) | 0.08 g/m² |
| Seventh Layer: Protective Layer | |
| Gelatin | 1.33 g/m² |
| Acryl-modified copolymer of polyvinyl alcohol (modification degree 17 mol %) | 0.17 g/m² |
| Liquid paraffin | 0.03 g/m² |

(Cpd-10) and (Cpd-11) were used as anti-irradiation dyes. Alkanol XC (by E. I. Du Pont de Nemours and Company), sodium alkylbenzenesulfonate, succinic acid ester and Magefacx F-120 (by DAI NIPPON INK & CHEMICALS, Inc.) were used as emulsification and dispersing agent and coating assistant in each layer. (Cpd-12) and (Cpd-13) were used as silver halide stabilizers. The silver emulsions used in Example 3 are as follows.

| Emulsion | Shape of Grain | Grain Size (μ) | Br Content (mol %) | Fluctuation Coefficient |
|---|---|---|---|---|
| EM1 | Cubic | 1.0 | 80 | 0.08 |
| EM2 | Cubic | 0.75 | 80 | 0.07 |
| EM3 | Cubic | 0.5 | 83 | 0.09 |
| EM4 | Cubic | 0.4 | 83 | 0.10 |
| EM5 | Cubic | 0.5 | 73 | 0.09 |
| EM6 | Cubic | 0.4 | 73 | 0.10 |

The compounds used in Example 3 are mentioned below.

Sensitizing Dyes:
ExS-1
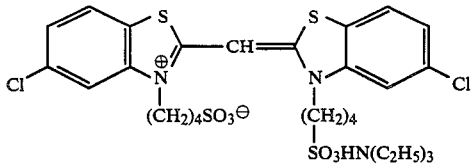
ExS-2
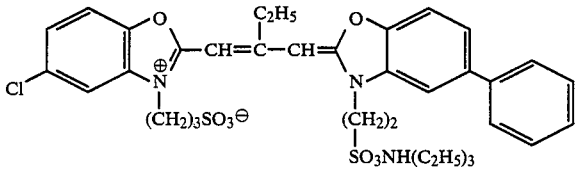
ExS-3
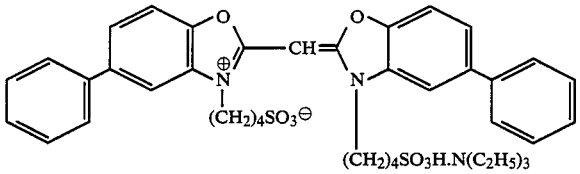
ExS-4
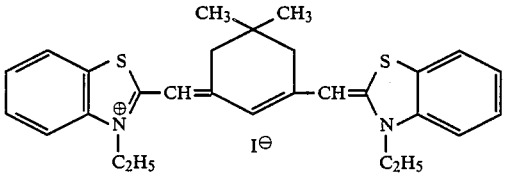
ExS-5
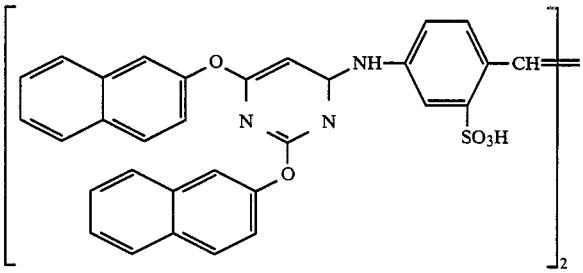
Cpd-4
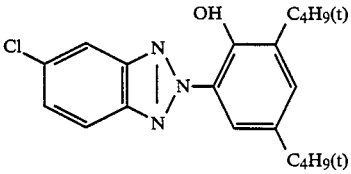
Cpd-5
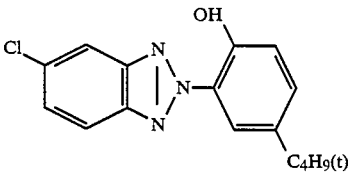
Cpd-6
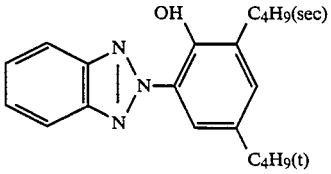

-continued
Sensitizing Dyes:
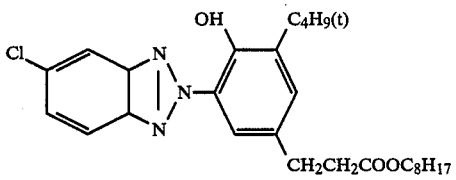
Cpd-8
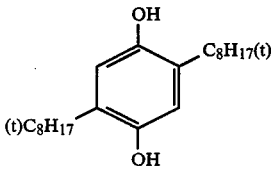
Cpd-7
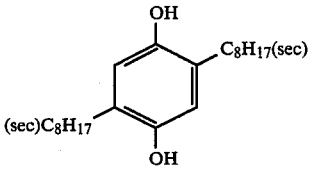
Cpd-2
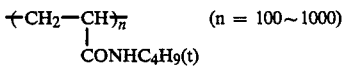
Cpd-9
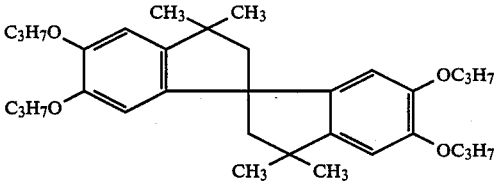
Cpd-3
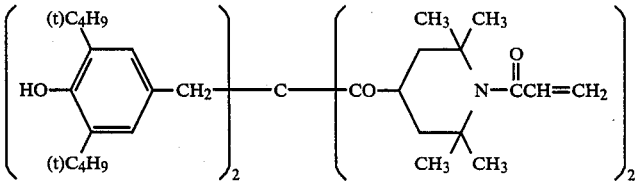
Cpd-1
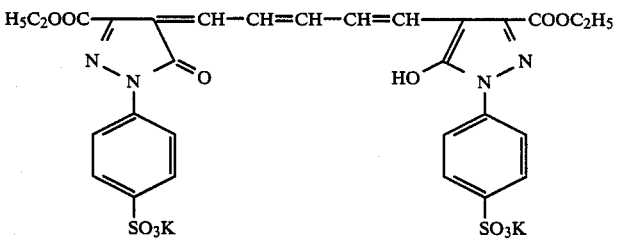
Cpd-10
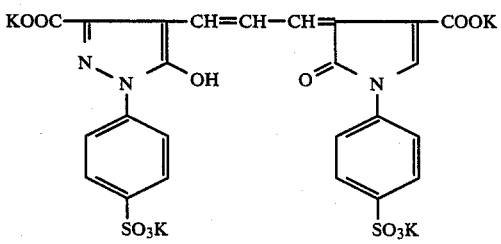
Cpd-11

Sensitizing Dyes:

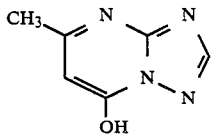

Cpd-12

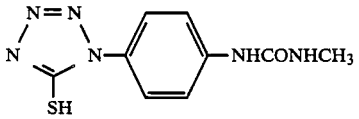

Cpd-13

Solv-1: Dibutyl Phthalate
Solv-2: Tricresyl Phosphate
Solv-3: Trioctyl Phosphate
Solv-4: Trinonyl Phosphate Samples Nos. 202 to 208 were prepared in the same manner as the preparation of the Sample 201, except that the couplers and/or the high boiling point solvents in the Sample 201 were replaced by others as shown in Table 3 below.

TABLE 3

| | 1st Layer | | 3rd Layer | | 4th Layer | 5th Layer | | 6th Layer |
|---|---|---|---|---|---|---|---|---|
| | Coupler | Solvent | Coupler | Solvent | Solvent | Coupler | Solvent | Solvent |
| 201 (Comparison) | C-(58)<br>C-(59) | Solv-1 | C-(9) | Solv-2<br>Solv-3 | Solv-4 | C-(49) | Solv-2 | Solve-2 |
| 202 (Invention) | C-(58)<br>C-(59) | S-1 | C-(9) | S-1 | Solv-4 | C-(49) | S-1 | Solv-2 |
| 203 (Comparison) | C-(57) | O-2 | C-(52) | O-2 | O-2 | C-(39) | O-2 | O-2 |
| 204 (Invention) | C-(57) | S-2 | C-(52) | S-2 | S-2 | C-(39) | S-2 | S-2 |
| 205 (Comparison) | C-(59) | Solv-1 | C-(51) | Solv-2 | Solv-4 | C-(50) | Solv-2 | Solv-2 |
| 206 (Invention) | | S-1 | | S-2 | Solv-4 | | S-1 | Solv-2 |
| 207 (Comparison) | C-(58)<br>C-(59) | O-3 | C-(9)<br>C-(27) | O-3 | O-3 | C-(49)<br>C-(47) | O-3 | O-3 |
| 208 (Invention) | C-(58)<br>C-(59) | S-1 | C-(9)<br>C-(27) | S-1 | S-1 | C-(49)<br>C-(47) | S-1 | S-1 |

The latent image storability of each of the thus prepared samples was tested in the same manner as in Example 1. (After exposure, the samples were developed as mentioned below.)

The latent image storability of the samples of the present invention was found superior to that of the comparative samples.

The development process was as follows:

The samples exposed were processed by running development with Fuji Color Paper Processor FPRP 115, under the conditions mentioned below.

| Processing Step | Temperature | Time | Amount of Replenisher (*) | Tank Capacity |
|---|---|---|---|---|
| Color development | 37° C. | 3 min 30 sec | 200 ml | 60 liters |
| Bleach-fixation | 33° C. | 1 min 30 sec | 55 ml | 40 liters |
| Rinsing (1) in water | 24–34° C. | 1 min | — | 20 liters |
| Rinsing (2) in water | 24–34° C. | 1 min | — | 20 liters |
| Rinsing (3) in water | 24–24° C. | 1 min | 10 liters | 20 liters |
| Drying | 70–80° C. | 1 min | | |

(*)This means the amount per m2 of the photographic material as being processed. The rinsing was carried out by three tank cascade system from the tank (3) to the tank (1).

The compositions of the processing solutions used are as follow.

| Color Developer | Tank Solution | Replenisher |
|---|---|---|
| Water | 800 ml | 800 ml |
| Diethylenetriaminepentaacetic acid | 1.0 g | 1.0 g |
| Nitrilo-triacetic acid | 2.0 g | 2.0 g |
| Benzyl alcohol | 15 ml | 23 ml |
| Diethylene glycol | 10 ml | 10 ml |
| Sodium sulfite | 2.0 g | 3.0 g |
| Potassium bromide | 1.2 g | — |
| Potassium carbonate | 30 g | 25 g |
| N—ethyl-N—(β-methanesulfonamido-ethyl)-3-methyl-4-aminoaniline sulfate | 5.0 g | 9.0 g |
| Hydroxylamine sulfate | 3.0 g | 4.5 g |
| Fluorescent brightening agent (WHITEX 4B of Sumitomo Chemical Co., Ltd.) | 1.0 g | 2.0 g |
| Water to make | 1000 ml | 1000 ml |
| pH (at 25° C.) | 10.20 | 10.80 |

| Bleach-fixing Solution | Tank Solution | Replenisher |
|---|---|---|
| Water | 400 ml | 400 ml |
| Ammonium thiosulfate (70 wt %) | 150 ml | 300 ml |
| Sodium sulfite | 13 g | 26 g |
| Ammonium ethylenediaminetetraacetato ferrate | 55 g | 110 g |
| Ethylenediaminetetraacetic acid disodium | 5 g | 10 g |
| Water to make | 1000 ml | 1000 ml |
| pH (at 25° C.) | 6.70 | 6.30 |

EXAMPLE 4

The samples 201 to 208 of Example 3 were processed in accordance with the processing procedure as mentioned below, and the latent image storability of each of the Samples thus processed was tested in the same manner as Example 3.

As a result, an especially preferred result was obtained by the process of Example 4 where no benzyl alcohol was used.

| Processing Step | Temperature | Time |
|---|---|---|
| Color Development | 35° C. | 45 sec |
| Bleach-fixation | 30–35° C. | 45 sec |
| Rinsing (1) in Water | 30–35° C. | 20 sec |
| Rinsing (2) in Water | 30–35° C. | 20 sec |
| Rinsing (3) in Water | 30–35° C. | 20 sec |
| Rinsing (4) in Water | 30–35° C. | 30 sec |
| Drying | 70–80° C. | 60 sec |

The compositions of the processing solutions used are as follows:

| | |
|---|---|
| Color Developer | |
| Water | 800 ml |
| Ethylenediamine-N,N,N',N'—tetra-methylene-phosphonic acid | 1.5 g |
| Glutamic acid | 6.0 g |
| Sodium chloride | 1.4 g |
| Potassium carbonate | 25 g |
| N—ethyl-N—(β-methanesulfonamidoethyl)-3-methyl-4-aminoaniline sulfate | 5.0 g |
| N,N—diethylhydroxylamine | 4.2 g |
| Fluorescent brightening agent (4,4'-diaminostilbene) | 2.0 g |
| Water to make | 1000 ml |
| pH (at 25° C.) | 10.10 |
| Bleach-fixing Solution | |
| Water | 400 ml |
| Ammonium thiosulfate (70 wt %) | 100 ml |
| Sodium sulfite | 18 g |
| Ammonium ethylenediaminetetraacetato ferrate | 55 g |
| Ethylenediaminetetraacetic acid disodium | 3 g |
| Ammonium bromide | 40 g |
| Glacial acetic acid | 8 g |
| Water to make | 1000 ml |
| pH (at 25° C.) | 5.5 |
| Rinsing Solution | |
| Ion Exchanged Water (Ca-content and Mg-content each were 3 ppm or less.) | |

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having provided thereon at least one hydrophilic organic colloid layer, said at least one layer comprising one or more photographic additives dispersed therein with at least one phthalic acid ester of the general formula (I):

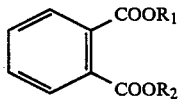

(I)

where $R_1$ and $R_2$, which may be same or different, each represents a branched alkyl group having 7 carbon atoms.

2. A silver halide photographic material as in claim 1, wherein the photographic additives comprise at least one substantially water-insoluble coupler and at least one other photographic additive.

3. A silver halide photographic material as in claim 1, wherein the phthalic acid ester(s) is(are) selected from the group consisting of compounds (S-1) to (S-6).

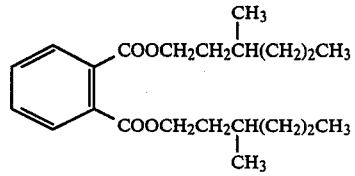

S-1

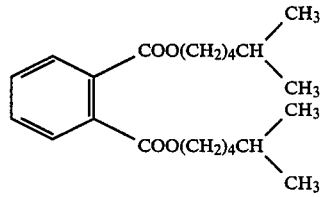

S-2

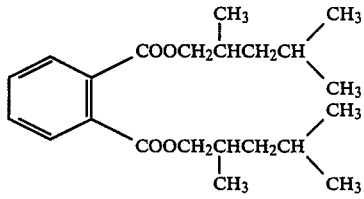

S-3

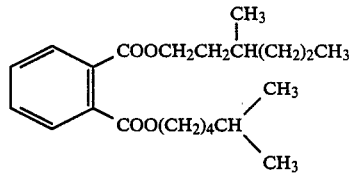

S-4

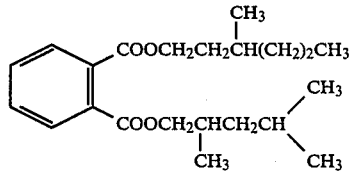

S-5

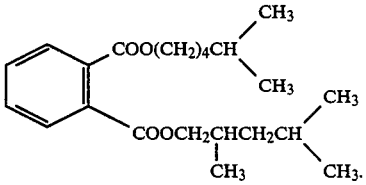

S-6

4. A silver halide photographic material as in claim 3, wherein the photograhic additives comprise at least one substantially water-insoluble coupler and at least one other photographic additive.

5. A photographic material as in claim 4, wherein the photographic additive is at least one selected fro the group consisting of chemical sensitizers, sensitivity elevating agents, spectral sensitizers, brightening agents, stabilizers, antifoggants, light absorbents, filter dyes, UV absorbents, stain inhibitors, color image stabilizers, hardeners, binders, plasticizers, lubricants, coating assistants, surfactants and antistatic agents.

6. A photographic material as in claim 4, wherein said coupler is at least one selected from the group consisting of yellow couplers, magenta couoplers, cyan couplers, colored couplers and DIR couplers.

* * * * *